United States Patent [19]

Weber et al.

[11] Patent Number: 4,586,897

[45] Date of Patent: May 6, 1986

[54] INSTALLATION INCLUDING A HEATING FURNACE FOR CONTINUOUS CASTINGS, WHICH ARE CUT TO LENGTH, FROM A CONTINUOUS CASTING INSTALLATION

[75] Inventors: Ralph Weber, Rio de Janeiro, Brazil; Herbert Rothe, Baden-Baden, Fed. Rep. of Germany

[73] Assignees: Kortec AG, Switzerland; Korf-BSW-Engineering GmbH, Fed. Rep. of Germany

[21] Appl. No.: 743,641

[22] Filed: Jun. 11, 1985

[30] Foreign Application Priority Data

Jun. 20, 1984 [DE] Fed. Rep. of Germany ..... 3422922

[51] Int. Cl.[4] ..... F27B 9/00; F27B 5/02; B21B 27/06; C21B 3/00

[52] U.S. Cl. ..... 432/121; 72/200; 266/276; 432/208

[58] Field of Search ..... 432/121, 126, 128, 163, 432/164, 207, 208; 72/200; 266/262, 276

[56] References Cited

U.S. PATENT DOCUMENTS 4,445,849 5/1984 Bouille ..... 432/164

FOREIGN PATENT DOCUMENTS 2723626 5/1977 Fed. Rep. of Germany ..... 432/128

*Primary Examiner*—John J. Camby

[57] ABSTRACT

In an installation including a heating furnace in the rolling mill and a continuous casting apparatus, there is provided a transportable temperature holding chamber for the castings which are cut to length, in which chamber the castings are transported in groups from the continuous casting apparatus to the heating furnace, and are stored temporarily in the buffer mode. That makes it possible to save energy and to improve the quality of the steels.

10 Claims, 6 Drawing Figures

Figure 1:
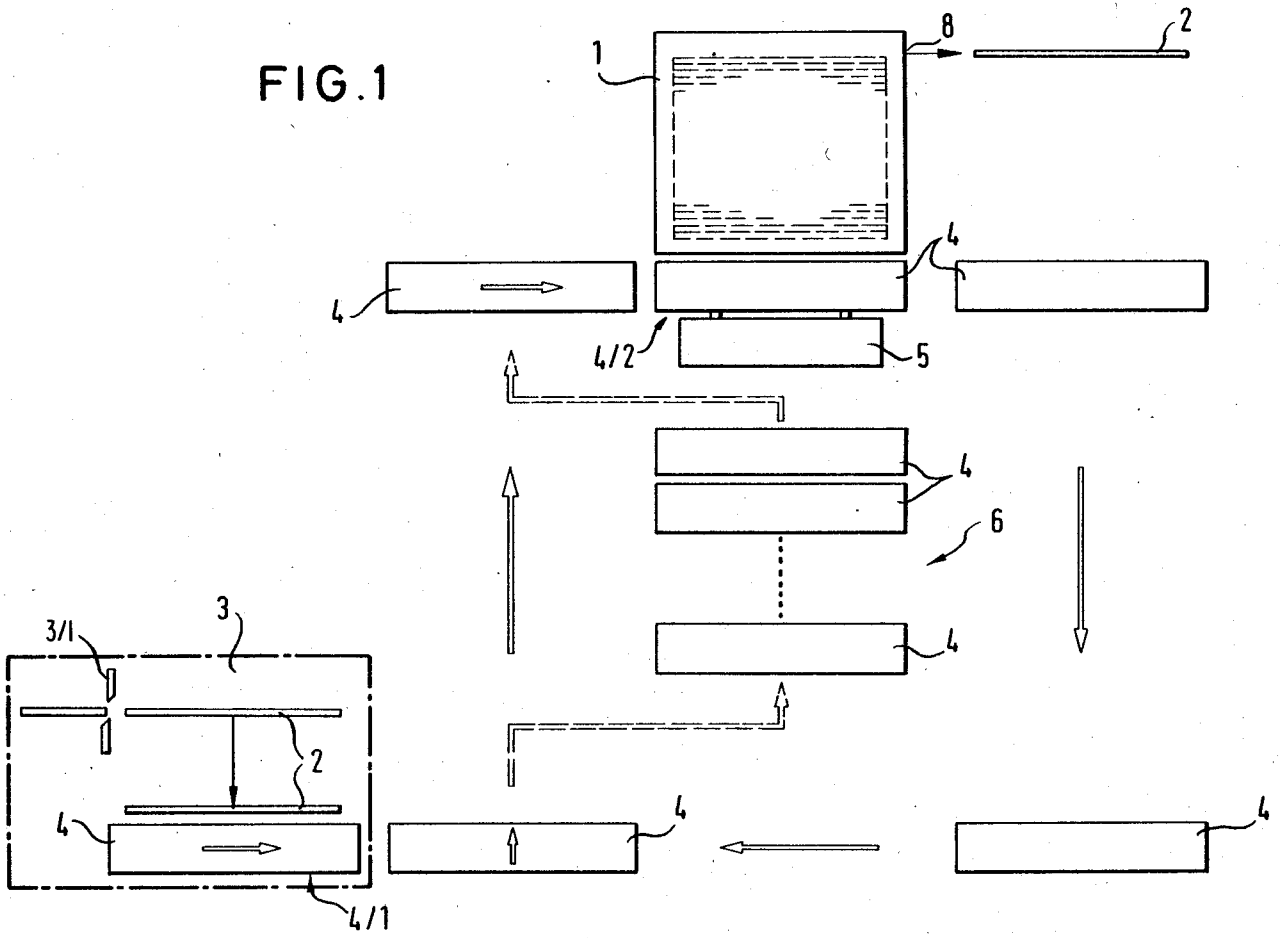

INSTALLATION INCLUDING A HEATING FURNACE FOR CONTINUOUS CASTINGS, WHICH ARE CUT TO LENGTH, FROM A CONTINUOUS CASTING INSTALLATION

DESCRIPTION

The invention relates to an installation including a heating furnace for continuous castings (billets, blooms or ingots), which are cut to length, from a continuous casting installation.

The hot continuous metal castings of square cross-section with a side length of for example 120 mm, as are produced for example in a continuous billet installation, are cut to a length of 9 or 15 meters, and cooled on turning cooling beds. The turning cooling beds turn the castings (billets) which have been cut to length, upon transverse transportation movement thereof, through 90° in each step. That mode of operation prevents the billet from being cooled down on one side due to the cold air rising from below, and thus prevents the billet from bending. After the cooling operation, the billets are transported to the rolling mill where they are heated to the required rolling temperature in a heating furnace, usually a walking beam furnace or a tunnel-type furnace, before the billets are passed to the roll stand. The operation of heating the billets must also be effected uniformly in the heating furnace, at least up to a temperature of about 750° to 800° C. for non-alloyed steel, in order to prevent the billets from bending (German patent specification No. 2 436 334 Feb. 20, 1975).

For reasons of saving energy, in combined steel rolling mechanisms, hot billets from the continuous casting installation are also introduced into the heating furnaces in the finishing trains. In that situation, even when the distances over which the billets are to be transported are short, it is not possible to prevent a drop in temperature of the hot billets as they go from the continuous casting installation to the heating furnace. As moreover existing installations are generally so designed that the output of the rolling mill is higher than that of the steel works, for example in a 16 hour period of operation per day the rolling mill can process the billets produced in a 24 hour period of operation of the steel works per day, it is necessary for some of the billets produced to be cooled down and stored so that it is not possible to eliminate the expensive turning cooling bed at the continuous casting installation.

German laid-open application (DE-OS) No. 27 06 345 Aug. 17, 1978 discloses a furnace arrangement for heating blooms which comprises at least two individual furnaces, namely a pusher or tunnel furnace and a preliminary furnace, through which the blooms pass in succession. In order to provide space for the pusher means of the pusher-type furnace, the line through the preliminary furnace, along which the blooms pass, is laterally offset with respect to that of the pusher-type furnace. The blooms which are introduced into the preliminary furnace in a cold condition, after passing therethrough, are conveyed by a transfer apparatus into a position in front of the charging opening of the pusher-type furnace and are introduced into that furnace by the pusher means thereof. The cold blooms are introduced into the preliminary furnace by a further pusher means. The preliminary furnace is heated by the waste gases from the pusher-type furnace. It is also possible for a plurality of preliminary furnaces to be associated with one pusher-type furnace. That furnace arrangement makes it possible to utilise the sensible heat of the waste gases of the pusher-type furnace and thereby to enhance the level of economy in regard to heating the blooms, and increasing the through-put of the pusher-type furnace.

German published specification (DE-AS) No. 11 89 575 Mar. 25, 1965 discloses a furnace arrangement for heating and post-heating of billets, wherein the heating furnace includes a preheating zone with a charging opening for the cold charge and a high temperature zone with a charging opening for hot charge. A discharging opening which is common to the two zones is disposed at the line of separation of the two zones. In that heating furnace, the billets only need to pass through one of the zones in order to arrive at the outlet which is common to the two zones. In conjunction with the preheating zone being heated by the hot waste gases of the high temperature zone, that consideration results in an improved level of thermal efficiency and an enhanced mode of operation of the heating furnace.

The object of the present invention is still further to reduce the energy losses and, with different hourly output rates of steel works and rolling mill, to permit a buffer mode of operation without a substantial increase in energy losses. The invention also seeks to provide that the installation is simplified in comparison with known installations, while the level of operating reliability is enhanced.

In the installation according to the invention, as it were a part of the heating furnace is formed as a transportable chamber which can be transported between a receiving position in the continuous casting installation and a delivery position directly in front of the charging opening of the heating furnace, and accommodates for example a quarter of the charge material of the heating furnace, that is to say for example 10 or 15 billets of a length of for example 9 meters. The length of the chamber for keeping the castings hot approximately corresponds to the width of the pusher furnace and by virtue of the opening of the chamber being adapted on one side to the charging opening of the heating furnace and by virtue of openings at the oppositely disposed side being adapted to the cross-section of the thrust rods of the pusher means, the heating furnace, in the casting delivery position, is supplemented by a chamber from which the castings contained therein can be loaded into the heating furnace by the pusher means. That arrangement provides a good sealing closure even in the region in which the thrust rods of the pusher means pass into the chamber. If the openings of the temperature holding chamber can be closed by slide members or flap members, then the rate of cooling of the hot castings introduced into the chamber, during storage or transportation, can be held at a value of less than 25° C. per hour. In that way, it is also possible for the material to be stored over a period of 8 hours, as may then be the case with a buffer mode of operation, without the temperature dropping by more than 150° to 200° C. If the continuous castings are introduced into the temperature holding chamber directly downstream of the severing means for the casting in the continuous casting installation, at a temperature of about 1000° C., then the temperature thereof, even after 8 hours, is still higher than 800° C., and there is no need for particular measures in the heating furnace to ensure uniform heating to the rolling temperature. There is no fear of the billets suffering from bending within the heating furnace, even when being heated on one side from above, so that the heating furnace can be of a low and thus more efficient design. There is no need for a preheating zone in the heating furnace.

It will be appreciated that, with a buffer mode of operation, it is necessary to provide a plurality of temperature holding chambers and a storage area along the path of transportation movement, as far as possible in the vicinity of the heating furnace. Transportation may be effected by means of a crane installation or by way of a railway. The size of the temperature holding chamber depends on the manner of transportation. The overall weight, in the case of a crane installation, will be between 3 and 15 t.

Figure 2:
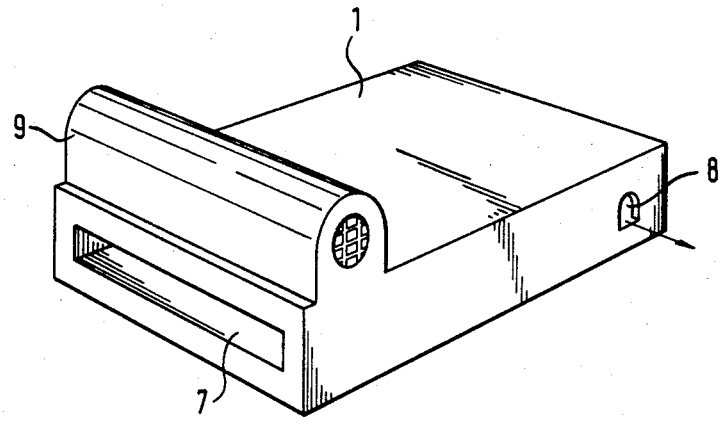
Figure 3:
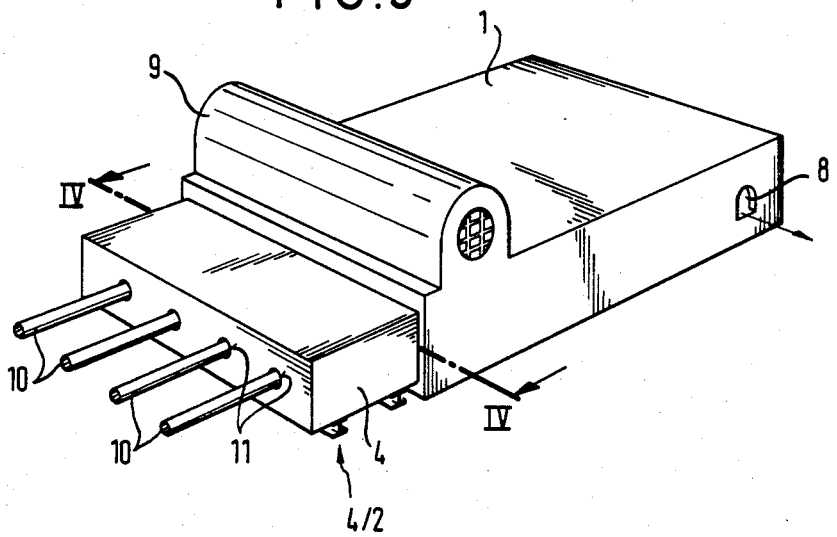
Figure 5:
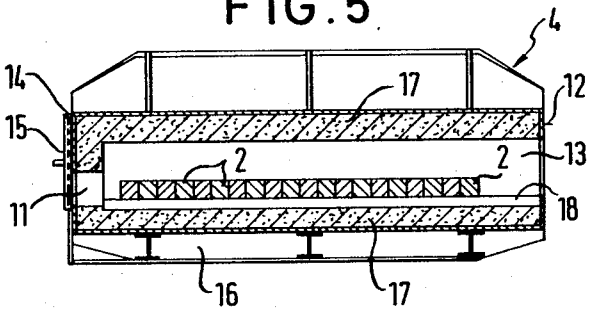
Figure 4:
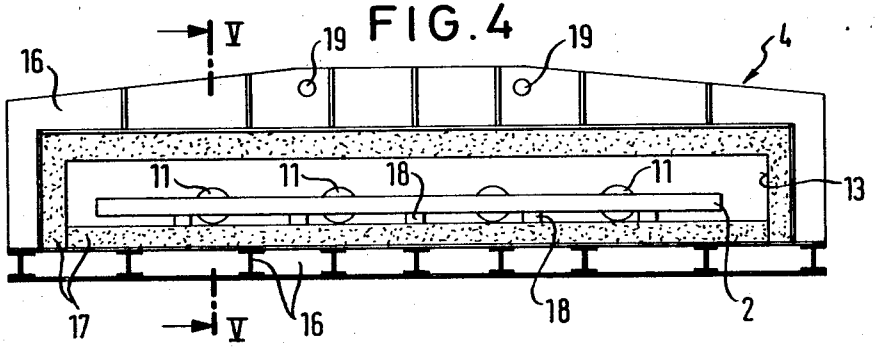
Figure 6:
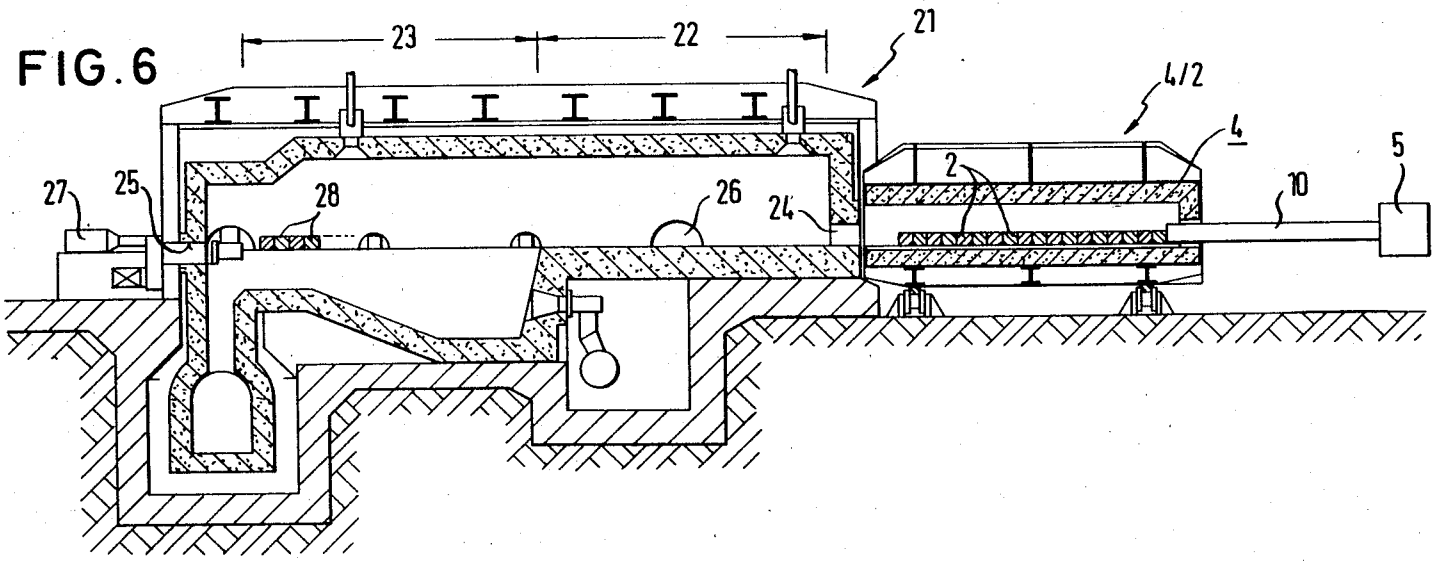

The invention is described in greater detail by means of an embodiment, with reference to six figures of drawings in which:

FIG. 1 is a view showing the basic principle of an installation according to the invention, illustrating the path of transportation movement of the chambers for keeping the castings hot, FIG. 2 is a diagrammatic perspective view of a heating furnace, FIG. 3 shows the heating furnace with a chamber for keeping the castings hot, in the delivery position, FIGS. 4 and 5 show a side view and a cross-sectional view of a chamber for keeping the castings hot, and FIG. 6 shows a heating furnace which can be charged with cold and hot billets, with a chamber for keeping the billets hot.

The basic diagrammatic view in FIG. 1 shows a heating furnace 1, which is associated with a rolling drain, for billets 2 which are produced in a continuous casting installation 3. Transportable chambers 4 for keeping the billets hot, or temperature-holding chambers, are provided for group-wise transportation of the hot billets supplied by the continuous casting installation 3. The chambers 4 can be transported between a receiving positon 4/1 downstream of the cutting means 3/1 for cutting the castings from the continuous casting installation, and a delivery position 4/2 between the charging opening of the heating furnace 1 and a pusher means 5. The path of transportation movement of the chambers 4 is indicated by arrows. A storage area 6 for a plurality of chambers 4 is provided beside the path of transportation movement.

The diagrammatic view of the heating furnace 1 shown in FIG. 2 illustrates the charging opening 7 which extends virtually over the entire width of the furnace, and the discharging opening 8. Reference numeral 9 denotes a flue gas discharge. The furnace may be constructed in known manner in the form of a pusher furnace or as a walking beam furnace. The openings thereof can be closed by flap members (not shown).

FIG. 3 shows the heating furnace of FIG. 2, with a temperature holding chamber 4 in the delivery position 4/2. FIG. 3 shows four thrust rods 10 of a pusher means 5, the remainder of which is not shown; the thrust rods 10 engage into second openings 11 which are adapted to the cross-section of the thrust rods.

FIG. 4 shows a view of a temperature holding chamber 4 in section on line IV–IV in FIG. 3, that is to say, as viewed from the heating furnace 1. FIG. 5 shows a view in section taken along line V–V in FIG. 4 of the chamber 4.

As shown therein, the chamber 4 is in the form of an elongate right-angled parallelepiped provided at one long side 12 thereof with a first opening 13 which is adapted to the charging opening 7 of the heating furnace 1, while at the oppositely disposed long side 14 it has second openings 11 which are adapted to the cross-section of the thrust rods 10 of the pusher means (see FIGS. 3 and 1). Both the first opening 13 and the second openings 14 can be closed by slide members, flap members or the like. For reasons of clarity, FIG. 5 only shows one slide member 15 of a second opening 11.

In the illustrated embodiment, the chamber 4 comprises a steel construction 16 which carries the walls 17 forming the chamber, comprising a heat-insulating material such as heat-insulating mats or a lining. Slide rails 18 on which the billets 2 are stored extend transversely to the long sides 12 and 14, within the chamber 4. Eyes 19 are provided in the support construction 16, for transportation purposes.

The mode of operation of the above-described installation will now be described with reference to FIGS. 1 to 5. In this connection, it is assumed that a double-line continuous casting installation with an output of 25 t per hour of operation and a bar steel rolling mill with an output of 33.5 t per hour of operation, which corresponds to an output of 45 t per hour of rolling, are available. It will be assumed that the continuous casting installation operates for 24 hours per day while the rolling mill operates for 16 hours per day.

While the rolling mill is stationary, the billets produced in eight hours are received at the continuous casting installation by twenty temperature holding chambers, each having a capacity of ten billets (120 mm$\times$120 m$\times$9000 mm, with a weight per billet of about 1000 kg). The temperature of the billets introduced was 980° C. (measured at the surface), at the continuous casting installation. After the billets had been introduced into the temperature holding chambers by means of a pusher device (not shown) in the continuous casting installation 3, the chambers were individually conveyed by a crane to the storage area 6 in the rolling mill, where they were set down. After 8 hours, the chambers 4 were successively brought into the delivery position 4/2 and the billets in the chambers were conveyed into the heating furnace by the pusher means 5. In that respect, the temperature of the billets in the first temperature holding chamber, which had been stored for 8 hours, was still 800° C. The supply of billets which is stored within the 8 hour period was used up after 5 hours, because of the higher rate of output of the rolling mill. In other words, after that period of time, the billets of the twentieth chamber were introduced into the heating furnace. In that chamber, the billet temperature was still 850° C.

After each temperature holding chamber has been emptied in the delivery position 4/2, it was returned by the crane over the path illustrated in FIG. 1 to the receiving position 4/1 in the continuous casting installation 3 and, after being charged with ten billets, conveyed to the storage area.

After 16 hours, the supply of stored billets was used up, the surface temperature of the billets introduced into the heating furnace being about 960° C.

The average consumption of heat per tonne of steel, when using the temperature holding chambers, was $0.628\times10^6$ kJ, while when temperature holding chambers were not used, it was $1.591\times10^6$ kJ, that is to say, about 2.5 times the former value. Thus, with the mode of operation described hereinbefore, the use of the temperature holding chambers permitted more than half the amount of energy involved to be saved.

The advantage of the temperature holding chambers lies not only in a substantial saving of energy but also in an improvement in the quality of the steels as the fact that the materials are kept hot at high temperatures means that diffusion equalisation occurs over a longer period of time than hitherto. As moreover there is also no fear of the billets bending in the temperature range above 750° C. which can be maintained when using the temperature holding chambers even when chambers are stored for up to 8 hours in the buffer mode (the rate of cooling is less than 25° C. per hour), the lower edge of the roof of the heating furnace can be kept very low whereby very high flow speeds in respect of the hot waste gases are achieved and convection heat is gained. In addition, the preheating zone can be eliminated in the heating furnace. It is sufficient for the heating furnace to have a high temperature or equalisation zone in which the hot billets at a temperature above 750° C. are heated to the rolling temperature.

FIG. 6 shows a view in section of a heating furnace 21 which has a high temperature zone 22 and a preheating zone 23. The heating furnace has a first charging opening 24 in the high temperature zone and a second charging opening 25 in the preheating zone, as well as a discharging or take-off opening 26 substantially at the centre of the high temperature zone. The delivery position 4/2 of the temperature holding chambers 4 is in front of the first charging opening 24. The hot billets 2 in the chambers 4 can be introduced into the high temperature zone 22 of the heating furnace 21 from the delivery position 4/2 by means of the pushrods 10 of the pusher means 5. In front of the second charging opening 25 is a second pusher means 27 for introducing cold billets 28 into the preheating zone 23. The preheating furnace in FIG. 6 is thus suitable for dealing with both cold charge material and also charge material which is kept in a hot condition by temperature holding chambers 4.

Although a crane installation was described hereinbefore as the means for transporting the temperature holding chambers, it will be appreciated that other transportation means, in particular a railway, can also be employed. It is also possible for the temperature holding chambers to be provided with a heating means, or to provide for heating at the storage area 6. As the temperature holding chambers closely connect to the heating furnace in the delivery position and as the first opening 13 is adapted to the charging opening 7 or 24, the temperature holding chambers can also be operated as a preheating zone or as preheating chambers by introducing thereinto the hot waste gases from the heating furnace.

We claim:

1. An installation including a heating furnace (1,21) for continuous castings (2) which are cut to length (billets, blooms, ingots), by severing means (3/1) from a continuous casting installation (3), the furnace having charging and discharging openings (7,8;24,26) for the continuous castings (2), a pusher means (5) which is arranged in front of the charging opening (7,24) and which includes at least two thrust rods (10) movable in the direction of the charging opening, a heat-insulated chamber (4) into which the castings (2) are introduced before being fed into the heating furnace (1,21), and a transportation means for transporting the castings (2) from the continuous casting installation (3) to the heating furnace (1,21), characterized in that said heat-insulated chamber is formed as a transportable temperature holding chamber (4) which can be transported by the transportation means between a receiving position (4/1) for receiving the castings downstream of the severing means (3/1) for severing the continuous casting from the continuous casting installation (3) and a delivery position (4/2) between the charging opening (7,24) of the heating furnace (1,21) and the pusher means (5).

2. An installation according to claim 1 characterised in that the temperature holding chamber (4) is in the form of an elongate right-angled parallelepiped and is provided at one long side (12) with a first opening (13) adapted to the charging opening (7, 24) of the heating furnace (1, 21) and at the oppositely disposed long side (14) with second openings (11) adapted to the cross-section of the thrust rods (10) of the pusher means (5).

3. An installation according to claim 1 characterised in that a storage area (6) for a plurality of temperature holding chambers (4) is provided beside the path of transportation movement.

4. An installation according to claim 2 characterised in that the second openings (11) of the temperature holding chamber can be closed off.

5. An installation according to claim 2 characterised in that the first opening (13) can be closed off.

6. An installation according to claim 2 characterised in that the temperature holding chamber has slide rails (18) extending transversely with respect to the long sides (12, 14) thereof.

7. A temperature holding chamber according to claim 1 characterised in that it includes at least one burner.

8. An installation according to one claim 4 characterized in that the first opening (13) can be closed off.

9. An installation according to one of claims 1 to 7 or 8 characterised in that the heating furnace contains only a high temperature zone (22).

10. An installation according to one of claims 1 to 7 or 8 characterised in that the heating furnace includes a high temperature zone (22) having a charging opening (24) on the side of the delivery position (4/2) of the temperature holding chamber (4) and a preheating zone (23) having a second charging opening (25) for cold continuous casting portions, on the oppositely disposed side of the heating furnace (21).

* * * * *